US005582294A

United States Patent [19]

Yamada

[11] Patent Number: 5,582,294

[45] Date of Patent: Dec. 10, 1996

[54] PACKET FOR WET TISSUE AND MANUFACTURING METHOD THEREOF

[75] Inventor: Kikuo Yamada, Kanazawa, Japan

[73] Assignee: Chiyoe Yamada, Kanazawa, Japan

[21] Appl. No.: 502,020

[22] Filed: Jul. 13, 1995

[30] Foreign Application Priority Data

Mar. 17, 1995 [JP] Japan ..... 7-086377
Jun. 19, 1995 [JP] Japan ..... 7-175524

[51] Int. Cl.[6] ..... B65D 81/24

[52] U.S. Cl. ..... 206/494; 206/812

[58] Field of Search ..... 206/210, 484, 206/449, 494, 812, 823

[56] References Cited

U.S. PATENT DOCUMENTS

| | | | |
|---|---|---|---|
| 4,171,047 | 10/1979 | Doyle et al. | 206/210 |
| 4,458,810 | 7/1984 | Mahoney | 206/210 |
| 4,848,575 | 7/1989 | Nakamura et al. | 206/494 X |
| 4,863,064 | 9/1989 | Dailey, III | 206/494 X |
| 5,040,680 | 8/1991 | Wilson et al. | 206/494 X |
| 5,344,007 | 9/1994 | Nakamura et al. | 206/494 X |

*Primary Examiner*—Jacob K. Ackun
*Attorney, Agent, or Firm*—Kanesaka & Takeuchi

[57] ABSTRACT

A packet for wet tissues including a lid structure being easy in opening/closing a wet tissue pick-up port. A wet tissue stacked body formed of a stack of wet tissues each being folded is contained in a bag formed of an air-tight film. A lid unit part including a pick-up port enabling pop-up of a wet tissue and a lid body for opening/closing the pick-up port is mounted on an opening portion provided on the bag. The lid unit part is composed of a base member and the lid body connected to the base member through a hinge, and the lid body is closed by the fitting between a fitting receptive portion provided on the base member and a fitting portion provided on the lid body, to thus seal the pick-up port.

8 Claims, 8 Drawing Sheets

PACKET FOR WET TISSUE AND MANUFACTURING METHOD THEREOF

BACKGROUND OF THE INVENTION AND DESCRIPTION OF THE RELATED ART

The present invention relates to a packet for wet tissues in which wet tissues are contained in a bag and are picked from the bag through a pick-up port one by one, and particularly to a packet for wet tissues which is portable and disposable.

In recent years, wet tissues have come to be extensively made available for business and domestic use, with the yearly increased consumption. A wet tissue is formed of a fabric sheet such as a nonwoven fabric impregnated with an impregnant such as a chemical or decorative agent, and is used for wiping the backsides of babies, removing stains from hands, disinfecting hands, and the like.

A packet for wet tissues has two types: one contains wet tissues in a box-like vessel; and the other contains them in a bag. In the former type, the box-like vessel is formed of a hard or semi-hard plastic molded product, and it contains folded wet tissues or a rolled wet tissue. The packet for wet tissues using the box-like vessel enables the repacking of the folded wet tissues or a rolled wet tissue.

On the other hand, in a packet for wet tissues using a bag, folded wet tissues are contained in a bag formed of an air-tight film, which is used as portable and disposable.

One example of the packet for wet tissues having a bag containing structure is disclosed in Japanese Patent Publication No. HEI 2-30948. The packet is so constructed that wet tissues are contained in a bag formed of an air-tight film. The bag is sealed at a center seal portion and at both end seal portions. A separable half-cut portion for forming a wet tissue pick-up port is provided on the upper surface of the bag, and a flap-like lid formed of an air-tight film is stuck on the half-cut portion for covering it by means of an adhesive applied on the back surface of the lid. When the lid is pulled up upon unsealing, the separable half-cut portion is pulled up together with the lid, to be separated from the pick-up portion, thus opening the pick-up portion. In this way, although the separated piece is bonded with the back surface of the lid, an adhesive surface is present around the separated pieces on the back surface of the lid, and accordingly, when the lid is closed, the adhesive surface is stuck on the film surface around the pick-up port, thus fixing the lid.

The packet disclosed in Japanese Patent Publication No. HEI 2-30948, however, has a disadvantage that since the lid is fixed by the adhesive force, after the lid is repeatedly opened/closed by several times, the adhesive surface is stuck with dust or refuse and is gradually reduced in its adhesive force, with a result that the sealing performance upon closing the lid is gradually deteriorated.

Moreover, since the bag is formed of a softening material such as a plastic film, wrinkles tend to be generated around the pick-up portion by opening/closing the lid, and consequently, there occurs an accident in which the adhesive surface of the lid is bonded with the film surface thus wrinkled, to thus close the lid. This leads to a reduction in the sealing performance.

The sealing performance of the lid is important for a packet for wet tissues. The imperfect sealing of the lid causes the volatilization of an impregnant such as a chemical or decorative agent impregnated in wet tissues, resulting in a critical defect.

In the packet provided with such a flap-like lid, it is difficult to speedily open/close the lid, and also it is impossible to open the lid by one hand.

On the other hand, U.S. Pat. No. 4,185,754 discloses a packet of a type in which wet tissues are contained in a bag, wherein a collar is mounted on a pick-up port provided on a bag, and a cap is provided on the collar through a hinge, thus sealing the pick-up port by the cap.

In the packet disclosed in this document, however, for picking up a wet tissue, a user must insert the fingers in the pick-up port to catch the folded end portion of the wet tissue for picking it from the pick-up port. Such an action is similarly performed for the second and later pick-up of wet tissues. It is very laborious and non-effective to insert fingers in the pick-up port for picking up a wet tissue.

The packet of this type includes the pick-up port having a size enough to allow the insertion of fingers therein for picking up a wet tissue. Namely, since the pick-up port has an excessively large opening area, an impregnant such as a chemical or decorative agent impregnated in wet tissues is volatilized in a large amount when the cap is opened. As a result, in the packet of this type, it is difficult to keep wet tissues in a desirable state for a long period of time.

Japanese Patent Publication No. SHO 64-3722 discloses a method of manufacturing a packet for wet tissues having a structure in which wet tissues are contained in a bag and a flap-like lid is stuck on the upper surface of the bag to cover a wet tissue pick-up port by means of an adhesive. The method includes the steps of forming a separable half-cut for forming a pick-up port of a sealed bag in a continuous air-tight sheet; sticking an opening/closing lid coated with an adhesive at one end and also coated with a pressure sensitive adhesive in the range at least wider than a portion becoming the pick-up port, on the sheet such that the portion coated with the pressure sensitive adhesive covers the portion becoming the pick-up port; placing a sheet like fabric material on the surface of the sheet opposed to that stuck with the opening/closing lid at the portion becoming the pick-up port; wrapping the sheet-like fabric material with the sheet and sealing the longitudinal and lateral openings of the sheet; and cutting the sheet in the lateral direction.

Since the method disclosed in the above document includes the step of coating the lid with an adhesive, the work is very laborious. Moreover, the lid must be stuck after the adhesive coated surface is accurately positioned so as to cover the pick-up port, thus making laborious the work, resulting in the poor workability.

OBJECT AND SUMMARY OF THE INVENTION

An object of the present invention is to provide a packet for wet tissues having a structure of containing wet tissues in a bag, which is excellent in sealing performance upon closing a lid, and is capable of preventing a reduction in the sealing performance even by repeatedly opening/closing the lid.

Another object of the present invention is to provide a packet for wet tissues, which is easy in picking up a wet tissue.

A further object of the present invention is to provide a packet for wet tissues, which is capable of suppressing the volatilization of an impregnant such as a chemical and decorative agent from a pick-up port at minimum.

Still a further object of the present invention is to provide a method of manufacturing a packet for wet tissues, which is suitable for continuously automatic production by simplifying the manufacturing processes.

A packet for wet tissues according to the present invention comprises a bag formed of an air-tight film, a lid unit part mounted on an opening portion provided on the bag, and a wet tissue stacked body contained in the bag. The lid unit part includes a pick-up port enabling pop-up of a wet tissue, and a lid body capable of sealing the pick-up port. The lid body is kept in the closed state by a physical action such as fitting or engagement.

The pick-up port enabling pop-up of a wet tissue has a shape/structure in which when a first wet tissue is pick up, the upper end portion of a second wet tissue is popped up from the pick-up port and is stopped at the popped-up position.

In the present invention, since the lid body is kept in the closed state by the physical action such as fitting or engagement, the pick-up port can be sufficiently and stably sealed. This eliminates the problem that the sealing performance is reduced due to a deterioration in an adhesive force as in the case of using the flap-like lid coated with an adhesive. Moreover, since wrinkles are not generated around the pick-up port, the pick-up port can be certainly sealed.

According to the present invention, it becomes possible to easily open/close the lid, and to open/close it by one hand.

In the present invention, the take-up port enabling pop-up of a wet tissue is effective to extremely easily pick up a wet tissue. Namely, in the present invention, it is not required to insert fingers in the pick-up port for catching a wet tissue, so that the pick-up port is not required to be large. As a result, the volatilization of an impregnant such as a chemical or decorative agent impregnated in wet tissues can be suppressed at minimum, and wet tissues in the bag can be kept in a desirable state.

In the present invention, since the wet tissue pick-up port and the lid body for opening/closing the pick-up port are constituted as a unit part, the bag for a packet for wet tissues can be simply manufactured only by joining the unit part onto the opening portion of the bag. According to the manufacturing method of the present invention, it is possible to eliminate the works of forming a half-cut for forming a pick-up port in a bag-making film and sticking a film-like lid formed with an adhesive surface previously coated with an adhesive on the half-cut surface, and hence to simplify the manufacturing processes.

DETAILED DESCRIPTION OF THE PREFERRED EMBODIMENTS OF THE INVENTION

The present invention will be described in detail with reference to the drawings.

Figure 1:
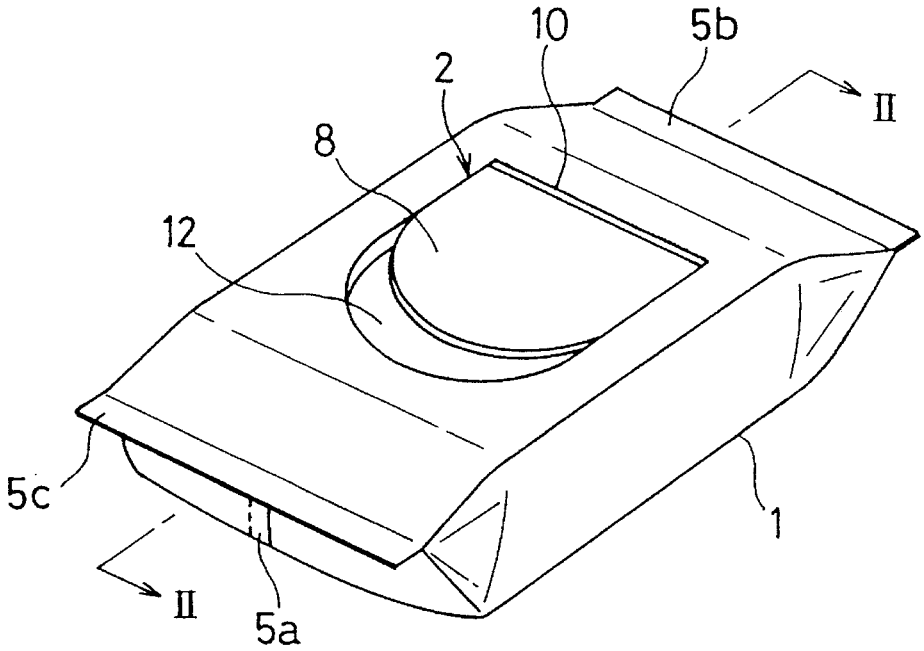
FIG. 1 is a perspective view showing one example of a packet for wet tissue according to the present invention.
Figure 2:
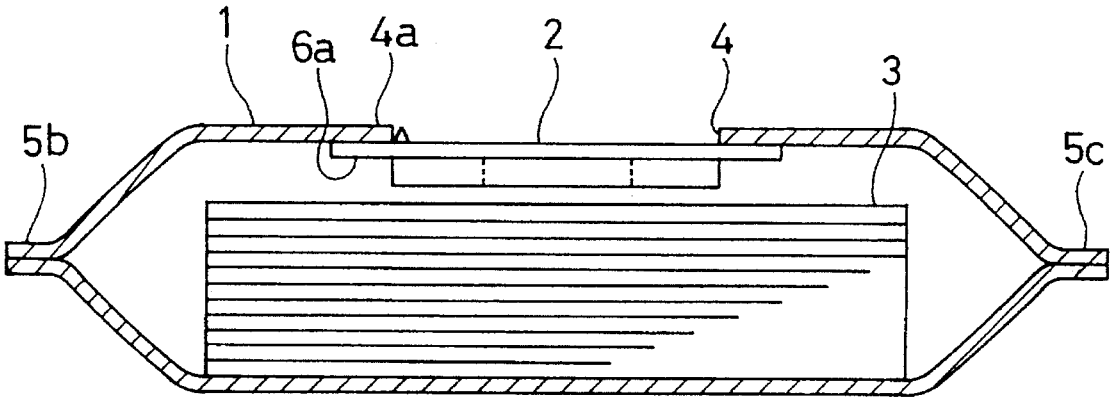
FIG. 2 is a vertical sectional view taken along line II—II of FIG. 1.

FIG. 1 shows one example of a packet for wet tissues according to the present invention. In the figure, reference numeral 1 indicates a bag, and reference numeral 2 indicates a lid unit part. As shown in FIG. 2, a wet tissue stacked body 3 is contained in the bag 1 including the lid unit part 2.

The bag 1 is formed of an air-tight film having a property capable of preventing the bleeding and volatilization of an impregnant such as a chemical and decorative agent from wet tissues. Specific examples of the film include a plastic film made of polyethylene, polypropylene, polyester, polyamide, polyvinyl chloride, polyvinylidene chloride, cellophane and acetate fiber; a laminated film formed of a combination of two or more kinds of the above films; and a complex film formed of the above single or laminated film laminated with an aluminum foil. In the case of using the laminated film or complex film, it is desirable that either surface of the film material can be heat-sealed.

The lid unit part 2 is mounted on the back surface of the upper film portion of the bag 1 in such a manner as to face to an opening portion 4 provided on the upper film portion of the bag 1. The upper surface of a peripheral portion **6*a* of a base member of the lid unit part 2 is abutted on the lower surface of a peripheral edge portion 4*a* of the opening portion 4 of the bag 1, and the mutual abutment portions are joined to each other by a joining means such as heat-seal. The lid unit part 2 is thus fixed on the back surface of the upper film portion of the bag 1 while facing to the opening portion 4 of the bag 1**. In addition, the above-described mutual abutment portions can be bonded to each other using an adhesive; however, they are desirable to be joined to each other by heat-seal.

The above-described lid unit part 2 is joined to a bag-making film in the process of manufacturing the bag 1. Specifically, a film is punched to form the opening portion 4, and the part 2 is placed on the film to face to the opening portion 4 and is joined to the film by a joining means such as heat-seal. A wet tissue stacked body 3 is wrapped by the film thus joined with the lid unit part 2. After that, center lap portions **5*a* of the film are joined to each other by a joining means such as heat-seal, and also end lap portions 5*b*, 5*c* formed at both the end portions in the direction along the center lap portions 5*a* are respectively joined to each other by a joining means such as heat-seal, thus forming the bag 1**.

Figure 3:
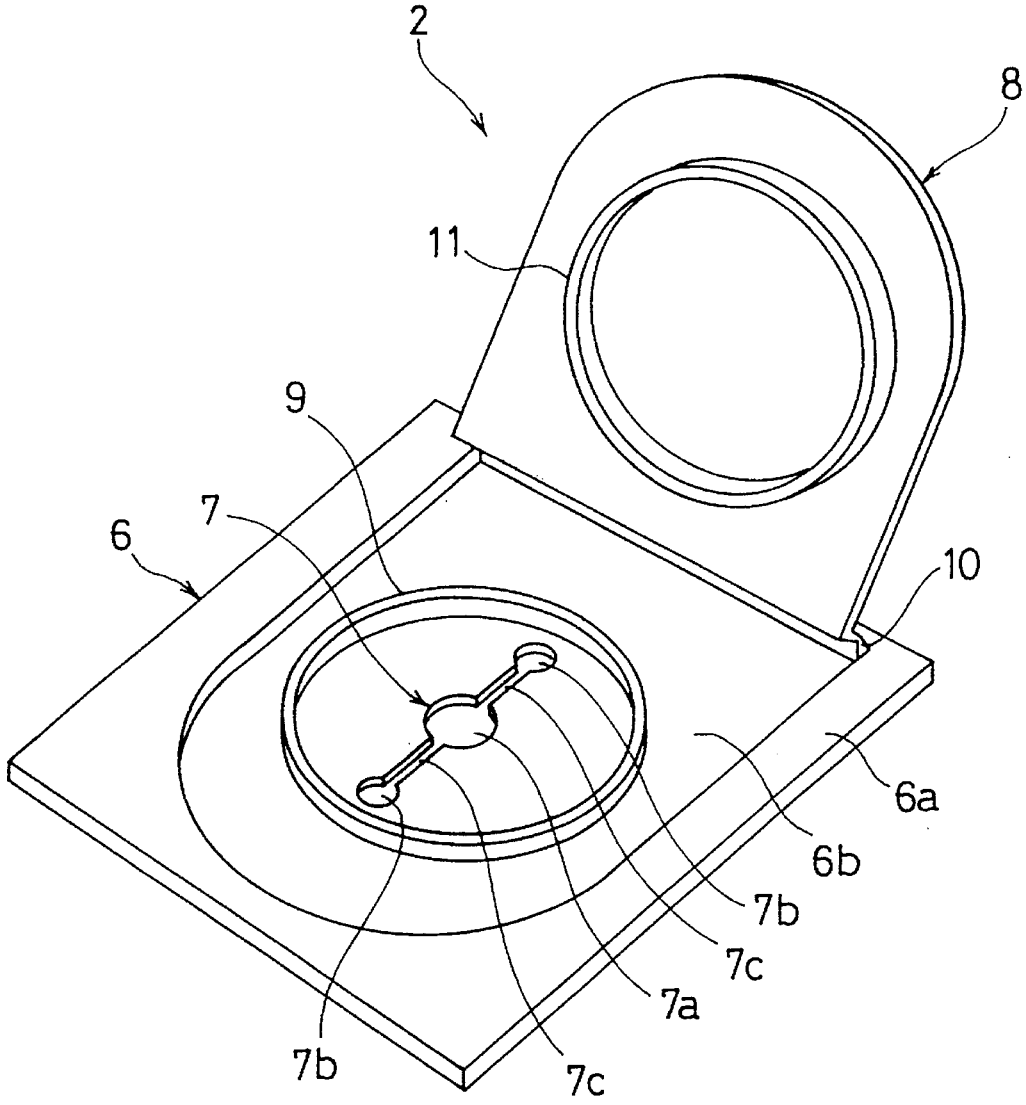
FIG. 3 is a perspective view of a lid unit part according to a first embodiment.
Figure 4:
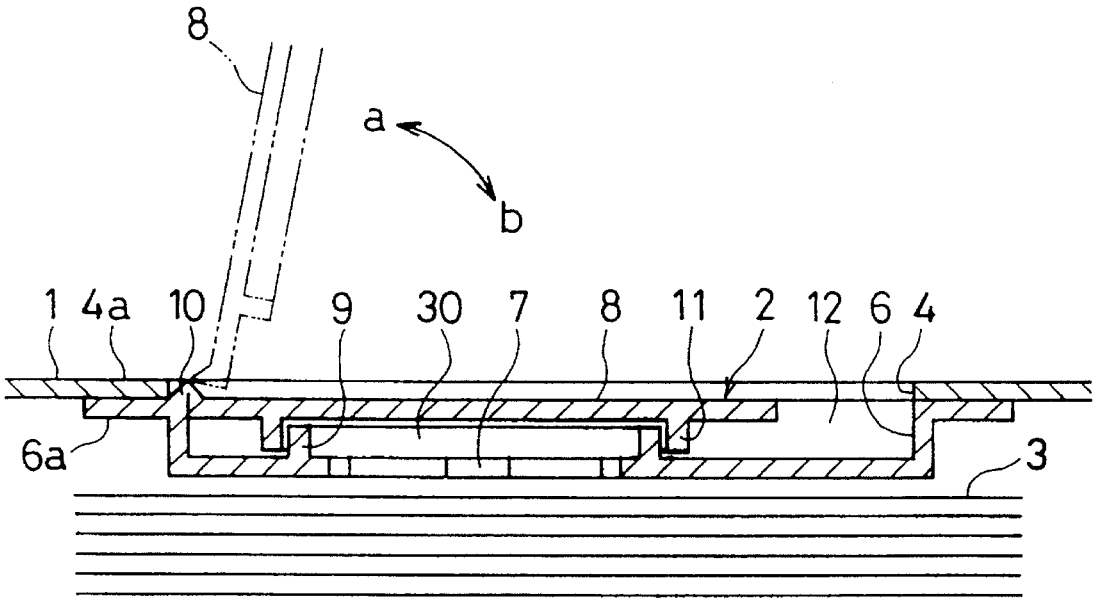
FIG. 4 is a vertical sectional view of an essential portion of the packet for wet tissues.

As shown in FIG. 3, the lid unit part 2 is composed of a base member 6, a wet tissue pick-up port 7 provided in the base member 6, and a lid body 8 capable of sealing the pick-up port 7. To seal the pick-up port 7 with the lid body 8, a fitting receptive portion 9 is provided around the pick-up port 7 of the base member 6, and a fitting portion 11 fittable with the fitting receptive portion 11 is provided on the lid body 8. Each of the fitting receptive portion 9 and the fitting portion 11 has a projecting peripheral wall, and the fitting state can be obtained by inserting the one peripheral wall in the other peripheral wall. As shown in FIG. 4, in this embodiment, the peripheral wall provided on the base member 6 is inserted in the peripheral wall provided on the lid body 8; however, the present invention is not limited thereto, and the peripheral wall provided on the lid body may be inserted in the peripheral wall provided on the base member.

The fitting portion 11 and the fitting receptive portion 9 are thus fitted with each other when the lid body 8 is closed, and thereby the lid body 8 is kept in the closed state. To seal the pick-up port 7, the fitting portion 11 and the fitting receptive portion 9 may be tightly fitted with each other.

Each of the fitting portion 11 and the fitting receptive portion 9 may be formed in a ring or square shape; however, to obtain the tight fitting therebetween, it is desirable to be formed in a ring shape.

The means for sealing the pick-up port 7 with the lid body 8 is not limited to the above-described fitting structure, and for example, the lid body 8 may be engaged with the pick-up port 7. In this way, the lid body 8 is kept in the closed state by the physical action such as fitting or engagement.

The lid body 8 is provided integrally with the base member 6 through a hinge 10 in such a manner as to be rockable around the hinge 10 in the rotational direction.

The pick-up port 7 provided on the base member 6 has a shape/structure capable of picking up a wet tissue by a pop-up system. Here, the pop-up system means a structure in which when the first wet tissue is perfectly picked from the pick-up port, the upper end portion of the second wet tissue is popped-up from the pick-up port and is stopped at the popped-up position.

With this pop-up structure, since the upper end portion of a wet tissue is usually in the state being popped-up from the pick-up port, there is an advantage in that a wet tissue is easy to be caught and to be picked from the pick-up port.

The pick-up port 7 comprises a center passage 7*a*, end passages 7*b*, and narrow passages 7*c* being narrower in width than the passages 7*a*, 7*b*. These passages 7*a*, 7*b* and 7*c* are interconnected to each other, to form one pick-up port. The narrow passage 7*c* functions to impart a suitable resistance to a force of pulling up a wet tissue, thus enabling the pop-up upon pick-up of the wet tissue.

The shape/structure of the pick-up port enabling the pop-up is not limited to that shown in FIG. 3. For example, the end passage 7*b* may be formed in the width similar to that of the narrow passage 7*c*. In this case, the center passage 7*a* is desirable to be slightly larger than that shown in FIG. 3. In summary, the pick-up port may be formed in the shape/structure capable of imparting a suitable resistance to a force of pulling up a wet tissue, and therefore, it can be variously changed.

The upper surface of the peripheral portion 6*a* of the base member 6, which is to be connected to the peripheral edge portion 4*a* of the opening portion 4 of the bag 1, is formed to be flat. A flat surface portion 6*b* of the base member 6 is formed at a position lower than the peripheral portion 6*a* so as to form a step therebetween.

In the state that the pick-up port 7 is closed by the lid body 8, as shown in FIG. 4, a space portion 30 is formed between the pick-up port 7 and the lid body 8. The space portion 30 has a space capable of substantially containing a pop-up portion of a wet tissue.

Since the lid body 8 does not cover all the surface of the flat surface portion 6*b* when it is closed, a recessed portion 12 is formed near the leading end portion of the lid body 8 as shown in FIG. 1. The recessed portion 12 has a size enough to allow the insertion of fingers of a user, and accordingly, upon opening the lid body 8, the user inserts the fingers in the recessed portion 12 and catches the lid body 8, thus easily opening the lid body 8.

The lid unit part 2 is preferably made of a hard or semi-hard plastic, for example, a thermoplastic resin such as polypropylene or polyethylene. The lid unit part 2 can be integrally molded by injection molding using a thermoplastic resin. The lid unit part 2 is not limited to be formed of a plastic but may be formed of a different material.

The wet tissue stacked body 3 is a stack of square shaped wet tissues each being folded. One wet tissue is folded in three, to form a folded body. These folded bodies are stacked such that the end portion of one folded body is caught by the end portion of another folded body. Such a stack structure of wet tissues is required for pick-up of wet tissues using the pop-up system.

As the material of a wet tissue, there may be used a sheet material, such as a paper sheet made of synthetic fibers or natural fibers, woven fabric, nonwoven fabric, cotton, gauze, or foam sheet, which is impregnated or coated with impregnant such as a chemical and decorative agent. The chemical includes alcohol for disinfection.

Figure 12:
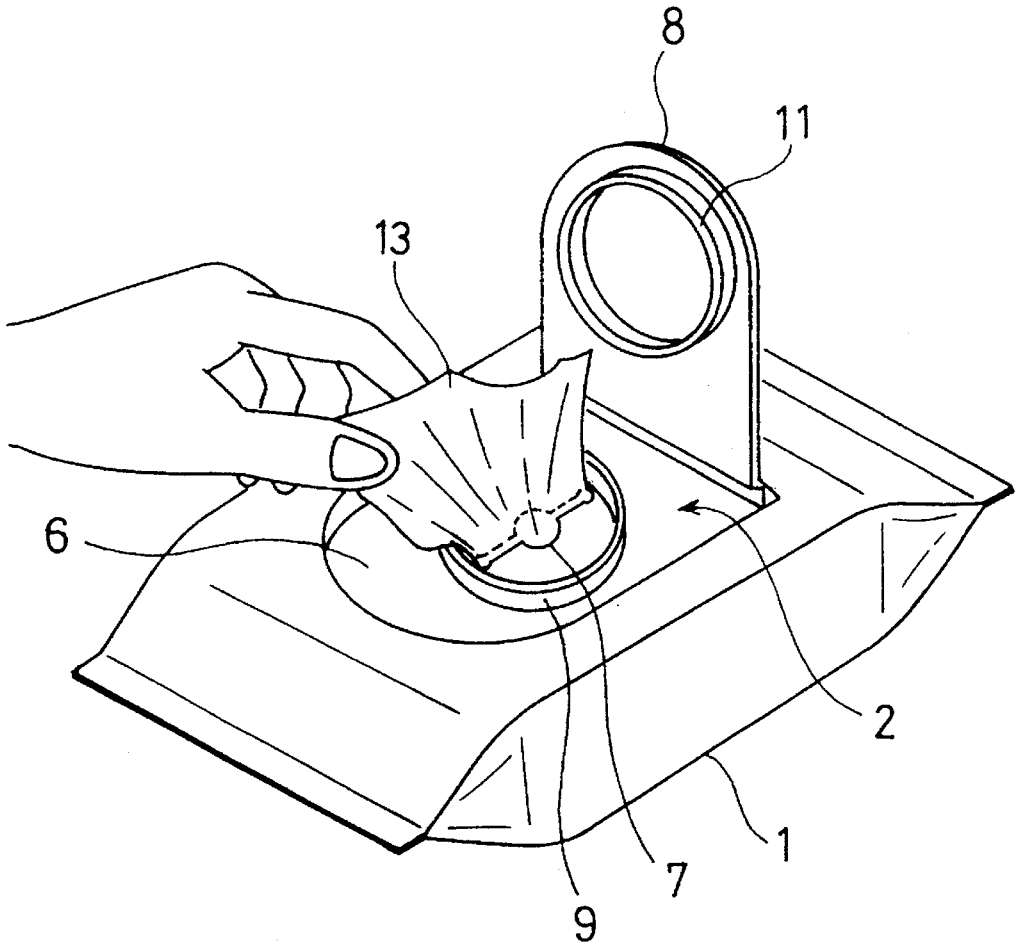
FIG. 12 is a perspective view of the packet of the present invention showing the state that a wet tissue is picked up.

In the packet for wet tissues according to the present invention, to pick-up a wet tissue, the lid body 8 is first turned in the direction of the arrow "a" in FIG. 4, to open the lid. In the case of using a new packet, a seal member (not shown) stuck on the pick-up port 7 is separated, and a wet tissue 13 is picked from the pick-up port 7. FIG. 12 shows the state that a wet tissue is picked up.

When the first wet tissue is picked up, the second wet tissue having the end portion which is caught by that of the first wet tissue is moved up together with the first wet tissue. When the first wet tissue 13 perfectly passes through the pick-up port 7, and the upper end portion of the second wet tissue passes through the pick-up port 7 and reaches an upper position near the pick-up port 7, the first wet-tissue is separated from the second wet tissue. Namely, the narrow passages 7*c* of the pick-up port 7 impart a suitable resistance against the force of pulling up the wet tissue, to release the catch between the end portions of the wet tissues. The first wet tissue is thus separated from the second wet tissue. Consequently, the second wet tissue is in the state that the upper end portion is popped-up from the pick-up port and stopped at the position. In this way, the upper end portion of the next wet tissue is popped-up from the pick-up port, and accordingly, it is easy to catch the wet tissue upon pick-up of the wet tissue.

Upon closing the lid body 8, the lid body 8 is turned in the direction of the arrow "b" in FIG. 4. At this time, the fitting portion 11 of the lid body 8 is tightly fitted with the fitting receptive portion 9 of the base member 6, and the lid body 8 is kept to seal the pick-up port 7 by this fitting.

When the lid body 8 is closed, the pop-up portion of the wet tissue is substantially contained in the space portion 30 between the inner surface of the lid body 8 and the pick-up port 7. This construction is advantageous in that the pop-up portion does not obstruct the closing of the lid body, thus eliminating an excessive load upon closing the lid body. The space portion 30 may be formed in a size not to perfectly contain the pop-up portion without any deformation but to contain it with a deformation.

Figure 5:
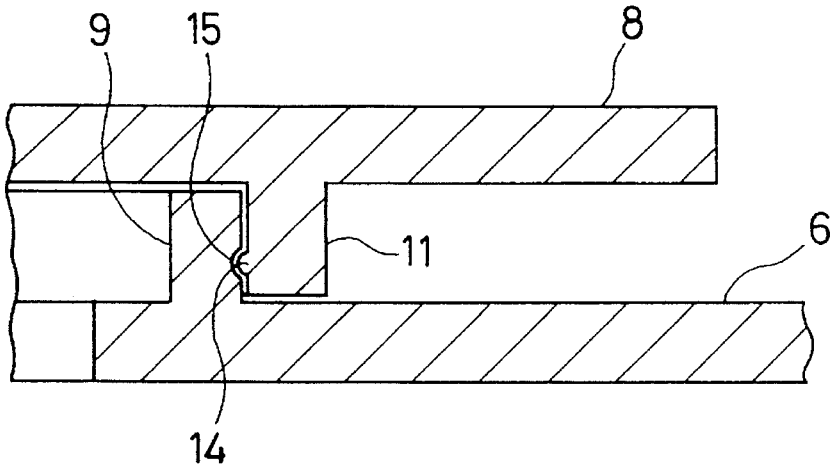
FIG. 5 is a vertical sectional view of an essential portion of the packet for wet tissues showing the fitted state in the case where a small projection is provided on a lid body.

In the present invention, as shown in FIG. 5, a small projection 14 may be provided along the inner peripheral surface of the fitting portion 11 of the lid body, and a recessed groove 15 fittable with the small projection 14 may be provided along the outer peripheral surface of the fitting receptive portion 9. With this construction, the fitting portion 11 and the fitting receptive portion 9 can be more tightly fitted with each other. As a result, the more perfectly tight closing of the pick-up port with the lid body can be obtained.

Figure 8:
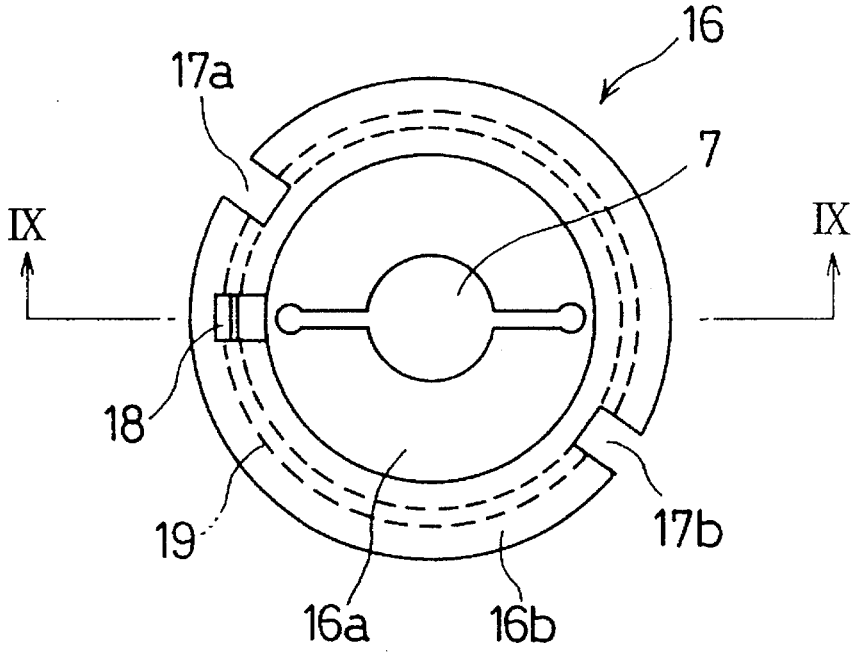
FIG. 8 is a plan view of a pick-up port forming member.
Figure 9:
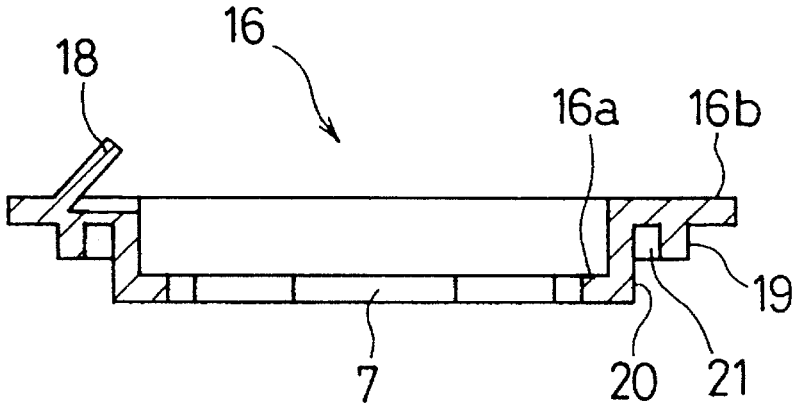
FIG. 9 is a vertical sectional view taken along line IX—IX of FIG. 8.

In addition, the tight closing of the pick-up port may be performed only by the fitting between the small projection 14 and the recessed groove 15. In the present invention, the pick-up port may be not directly provided on the base member of the lid unit part but on a part formed separately from the base member, the part being mounted on the base member. One example of the part formed with the pick-up port is shown in FIGS. 8 and 9. As shown in these figures, a pick-up port forming member 16 is formed in a circular shape and has a flat surface portion 16*a* and the flange portion 16*b*. The flat surface portion 16*a* is provided at a position lower than the flange portion 16*b* to form a step therebetween.

A pick-up port 7 is provided in the flat surface portion 16*a*, and recessed portion 17*a*, 17 are formed at two opposed positions of the flange portion 16*b*. A knob 18 is provided near the recessed portion 17*a*. A continuous projection 19 is provided on the back surface of the flange portion 16*b*, and a groove 21 is formed between an outer peripheral wall 20 of the flat surface portion 16*a* and the projection 19.

Figure 6:
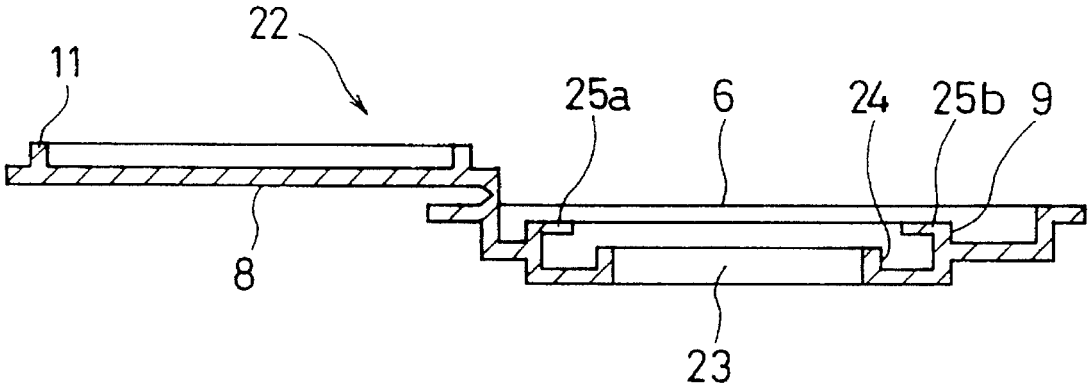
FIG. 6 is a vertical sectional view of a main body of a lid unit part according to a second embodiment.

The pick-up port forming member 16 having the above construction is assembled in a main body 22 of a lid unit part shown in FIG. 6. A mounting hole 23 for mounting the member 16 is provided in a base member 6 of the main body 22, and a projecting wall 24 is formed along the peripheral edge of the mounting hole 23.

Figure 7:
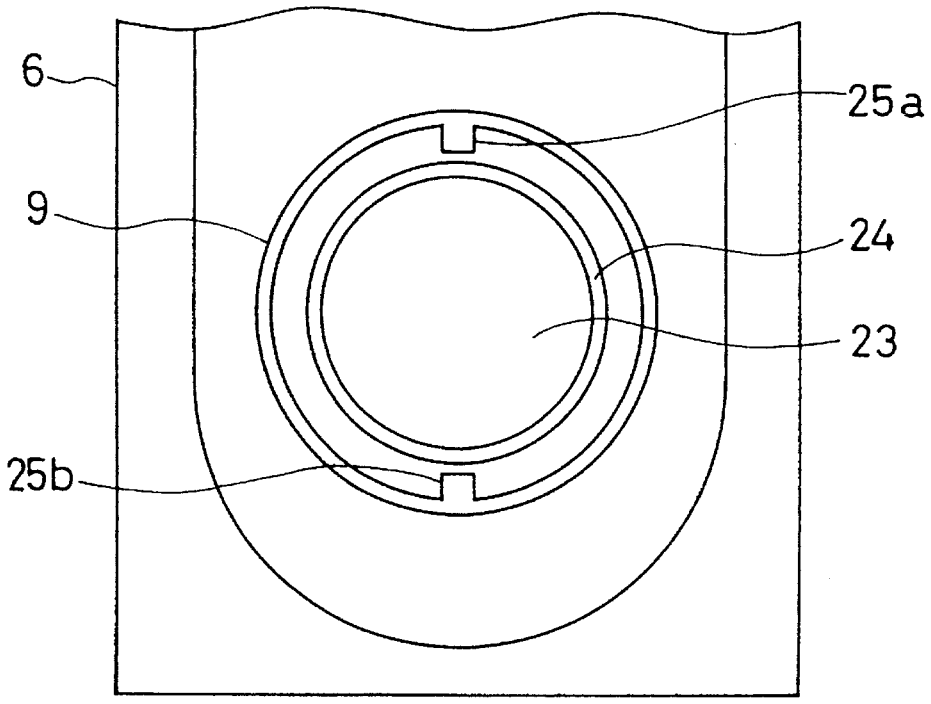
FIG. 7 is a plan view of a base member of the lid unit part according to the second embodiment.

As shown in FIG. 7, a fitting receptive portion 9 is provided around the projecting wall 24 so as to be coaxial therewith, and projecting pieces 25*a*, 25*b* are provided on the fitting receptive portion 9 so as to face to each other.

Figure 10:
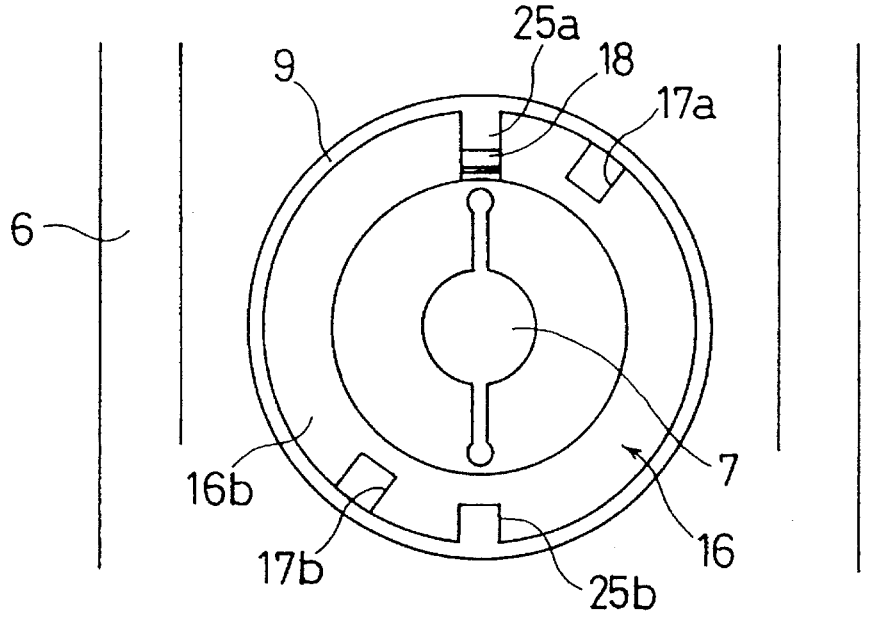
FIG. 10 is a plan view showing the state that the pick-up port forming member is mounted on the base member.
Figure 11:
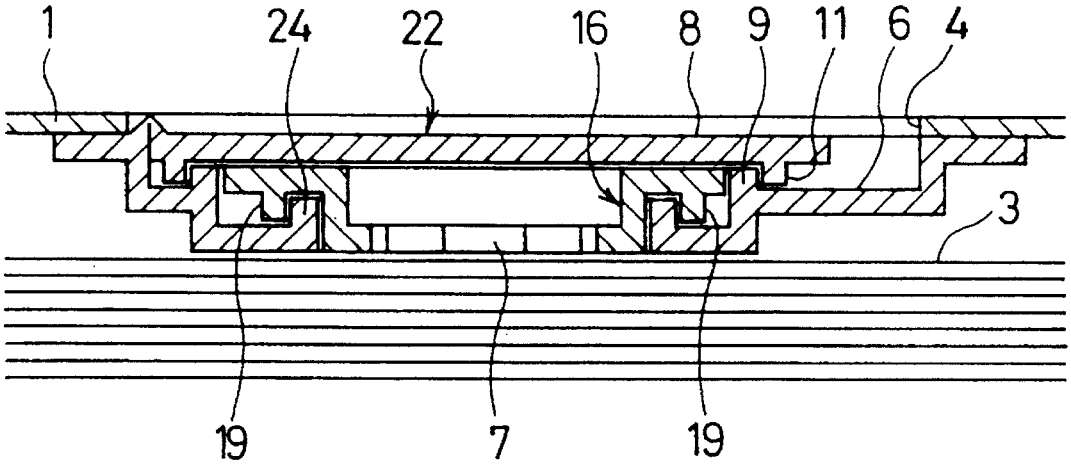
FIG. 11 is a vertical sectional view showing an essential portion of a packet according to the present invention using the lid unit part according to the second embodiment.

The member 16 is assembled in the main body 22 by positioning the recessed portions 17*a*, 17*b* of the member 16 to the projecting pieces 25*a*, 25*b* of the fitting receptive portion 9 respectively, and pressing the member 16 in the main body 22 such that the outer peripheral wall 20 of the member 16 is fitted with the mounting hole 23 of the base member 6. At this time, the outer peripheral wall 20 is tightly fitted with the mounting hole 23 and simultaneously the projecting wall 24 of the base member 6 is inserted in the groove 21 of the member 16 so that the projection 19 of the member 16 is fitted with the projecting wall 24 of the base member 6. Next, as shown in FIG. 10, when the member 16 is rotated by suitable angles, the projecting pieces 25*a*, 25*b* are shifted from the recessed portions 17*a*, 17*b*, with a result that the member 16 is locked by means of the projecting pieces 25*a*, 25*b*. In such a state, even by pulling up the member 16, the member 16 cannot be removed from the base member 6. The member 16 is thus assembled in the main body 22, as shown in FIG. 11. In addition, the knob 18, recessed portions 17*a*, 17*b*, projecting pieces 25*a*, 25*b* are not limited to be provided at the positions shown in FIGS. 7 and 8, but can be provided at other positions.

There sometimes occurs an accident in which when the first wet tissue is picked up, the end portion of the second wet tissue is not popped up from the pick-up port 7, thereby making it difficult to pick up the second wet tissue. In this case, the member 16 is effective to cope with such an inconvenience. Namely, the member 16 can be easily removed from the base member 6 by rotating the member 16 such that the recessed portions 17*a*, 17*b* correspond in position to the projecting pieces 25*a*, 25*b*, and pulling up the member 16 through the knob 18.

The mounting hole 23 has a size enough to allow the insertion of the fingers of a user. Accordingly, the user inserts the fingers in the mounting hole 23 to catch the end portion of the wet tissue. After that, the user inserts the end portion of the wet tissue in the pick-up port 7 of the member 16, and set the wet tissue such that the end portion thereof projects by a suitable length from the pick-up port 7. In such a state, the user returns the member 16 to the original position and fixes it. The pick-up of wet-tissues is thus made possible again.

In the present invention, the lid body 8 may be provided separately from the base member 6 and connected thereto by means of a hinge. In this case, the hinge may be replaced with a string-like connecting member for connecting the lid body to the base member. Alternatively, the opening/closing of the pick-up port with the lid body may be performed in the state that the lid body is not connected to the base member but separated therefrom.

Figure 13:
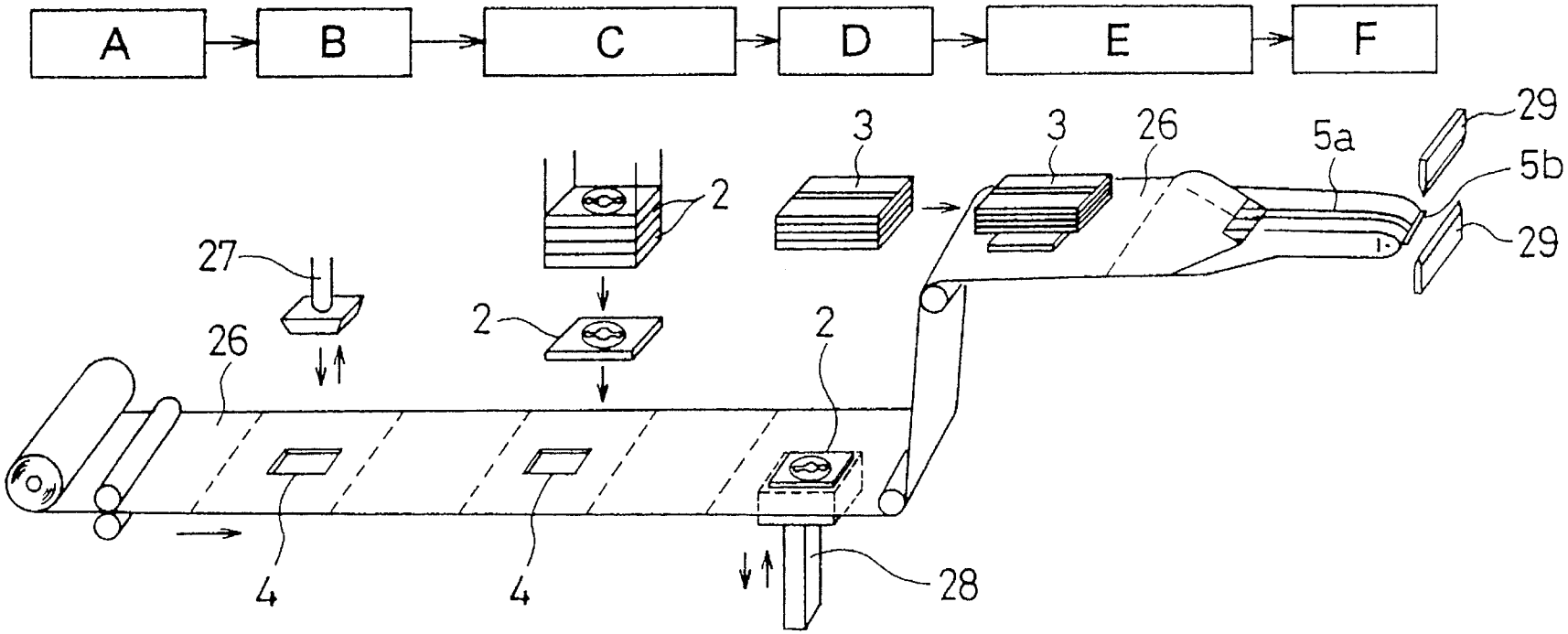
FIG. 13 is a schematic diagram showing processes of manufacturing the packet of the present invention.

Next, a method of manufacturing a packet for wet tissues according to the present invention will be described with reference to FIG. 13.

Process A: A bag-making film 26 made of an air-tight film is continuously fed by a feeder in such a manner that the side which forms the inner surface of a bag is directed upward.

Process B: A hole having a suitable size is punched in the film by a punching machine 27, to form an opening portion 4.

Process C: A lid unit part 2 is supplied and placed on the film at a position where the opening portion is formed, and then it is temporarily fixed thereto.

Process D: The film 26 is joined with the lid unit part 2 through heat-seal by pushing a heating board of a heat-seal device 28 onto the peripheral edge of the opening portion 4 from the back side of the film 26. High frequency seal or ultrasonic seal may be used, other than the heat-seal. The bonding using an adhesive can be also performed.

Process E: A wet tissue stacked body 3 is prepared by folding each of wet tissues made of paper or the like impregnated with an impregnant such as a chemical, and stacking them in a plurality of layers such that the end portions are caught with each other. The wet tissue stacked body 3 is supplied and placed on the film 26 at the position where the lid unit part is formed.

Process F: The wet tissue stacked body 3 is wrapped with the film 26 using a bag-making machine. After that, center lap portions 5*a* of the film 26 are joined to each other by a joining means such as heat-seal, and also end lap portions 5*b* and 5*c* formed at both the end portions in the direction along the center lap portions 5*a* are respectively joined to each other by a joining means such as heat-seal, to thus form a bag. The each boundary portion between the bags continuously formed is thermally cut by a heating edge 29, to separate each bag. A packet for wet tissues according to the present invention is thus obtained.

What is claimed is:

1. A packet for wet tissues comprising:

a bag formed of an air-tight film;

a lid unit part mounted on an opening portion provided on said bag; and a wet tissue stacked body contained in said bag;

wherein said lid unit part includes a pick-up port enabling pop-up of a wet tissue, and a lid body capable of sealing said pick-up port.

2. A packet for wet tissues according to claim 1, wherein said lid unit part comprises a base member including a pick-up port enabling pop-up of a wet tissue and a fitting receptive portion provided around said pick-up port; and a lid body including a fitting portion fittable with said fitting receptive portion.

3. A packet for wet tissues according to claim 2, wherein said lid body is connected to said base member through a hinge.

4. A packet for wet tissues according to claim 1, wherein said lid unit part comprises a base member including a mounting hole and a fitting receptive portion provided around said mounting hole; a pick-up port forming member removably mounted on said mounting hole of said base member; and a lid body including a fitting portion fittable with said fitting receptive portion of said base member.

5. A packet for wet tissues according to claim 4, wherein said lid body is connected to said base member through a hinge.

6. A packet for wet tissues according to claim 1, wherein said pick-up port has a shape/structure capable of imparting a suitable resistance against a force of pulling up a wet tissue.

7. A packet for wet tissues according to claim 6, wherein said pick-up port has a narrow passage capable of imparting a suitable resistance against a force of pulling up a wet tissue.

8. A packet for wet tissues according to claim 1, wherein in the state that said pick-up port is closed with said lid body, a space portion capable of substantially containing a wet tissue pop-up portion is formed between said pick-up port and said lid body.

* * * * *